US005225301A

United States Patent [19]

Yushina et al.

[11] Patent Number: 5,225,301

[45] Date of Patent: Jul. 6, 1993

[54] ELECTROPHOTOGRAPHIC YELLOW TONER AND PROCESS FOR PRODUCING THE SAME

[75] Inventors: Heihachi Yushina, Tokyo; Yukihiro Sato, Kanagawa; Yasuo Kamoshita, Kanagawa; Hirofumi Oda, Kanagawa, all of Japan

[73] Assignee: Mitsubishi Kasei Corporation, Tokyo, Japan

[21] Appl. No.: 810,137

[22] Filed: Dec. 19, 1991

[30] Foreign Application Priority Data

Dec. 21, 1990 [JP] Japan ..... 2-405214
Feb. 7, 1991 [JP] Japan ..... 3-16607

[51] Int. Cl.[5] ..... G03G 9/09
[52] U.S. Cl. ..... 430/106; 430/137
[58] Field of Search ..... 430/110, 124, 109, 106, 430/137

[56] References Cited

U.S. PATENT DOCUMENTS 4,073,965 2/1978 Mammino et al. ..... 427/22
4,539,284 9/1985 Barbetta et al. ..... 430/110
4,561,899 12/1985 Matrick ..... 106/193

FOREIGN PATENT DOCUMENTS 0162577 11/1985 European Pat. Off. .
2325965 4/1977 France .

OTHER PUBLICATIONS

Abstract of JP-A 2149857.
Abstract of JP-A 5937553.

*Primary Examiner*—John Goodrow
*Attorney, Agent, or Firm*—Sughrue, Mion, Zinn, Macpeak & Seas

[57] ABSTRACT

An electrophotographic yellow toner comprising binder resins having dispersed therein acetoacetanilide type monoazo pigments in its amorphous phase. The toner is excellent in transparency and spectral reflection characteristics. The toner is prepared by a process comprising a step of subjecting a colorant containing acetoacetanilide monoazo pigments and binder resins to heat treatment at a temperature higher than the softening point of the binder resin by at least 40° C.

9 Claims, 1 Drawing Sheet

ELECTROPHOTOGRAPHIC YELLOW TONER AND PROCESS FOR PRODUCING THE SAME

FIELD OF THE INVENTION

The present invention relates to a yellow toner for electrophotography, particularly color electrophotography, and to a process for producing the same.

BACKGROUND OF THE INVENTION

Various electrophotographic techniques have been proposed as disclosed, e.g., in U.S. Pat. No. 2,297,691, JP-B-42-23910, and JP-B-43-24748 (the term "JP-B" as used herein means an "examined Japanese patent publication"). Electrophotography generally comprises forming an electrostatic latent image on a photoreceptor by utilizing a photoconductive substance, developing the latent image with toner, and after the toner image is transferred to paper, etc., fixing the toner image by applying heat, pressure or solvent vapors.

Color copying by electrophotography is carried out by repeatedly exposing an original to light through a color separation filter and developing each electrostatic latent image with a corresponding color toner, e.g., yellow, magenta, and cyan color toners, to form a color image comprising a plurality of toners images overlapped.

Color toner comprise a binder resin having dispersed therein colorants, e.g., dyes and pigments, which are finely ground to powder of about 1 to 30 μm. Such toner powder is used as a mixture with a carrier substance such as glass beads, iron powder, or fur.

The above-described color toners as well as a generally employed black toner are required to have (1) excellent tribo chargeability, (2) no dependence on environmental conditions such as temperatures and humidities (i.e., characteristics unchangeable with changes of the environment), and (3) durability (i.e., resistance to deterioration on repeated use). In addition, the color toners are particularly required to have (4) satisfactory spectral reflection characteristics for obtaining a reproduced image with high fidelity, (5) high transparency for allowing overlapping of a plurality of colors, and (6) satisfactory color mixing properties with other color toners.

Among these requirements, transparency of toners after image fixing has a great infiuence on not only color mixing properties in overlapping multicolor toners but also color developability of an OHP-projected (OHP: overhead projector) image in the case where an image is formed on a transparent resin sheet. Transparency of toners greatly depends on the colorant used. Most pigments used as a colorant fail to exhibit sufficient transparency even though satisfactory in other requirements.

In particular, many acetoacetanilide monoazo pigments, a typical type of yellow pigment, fail to meet the transparency requirement. It has thus been considered impossible to obtain a yellow toner excellent in transparency by using this type of pigment according to the conventional methods for producing toners.

Therefore, other types of pigments have been used as colorants of yellow toners having transparency. However, many of the other pigments are more expensive than acetoacetanilide monoazo pigments, causing a rise of cost of toner production. Moreover, since the choice of the other pigments is limited, it has been difficult to obtain an arbitrary color tone.

SUMMARY OF THE INVENTION

As a result of extensive investigations, the present inventors have found that a yellow toner having markedly improved transparency as well as excellent other characteristics can be obtained by dispersing acetoacetanilide type monoazo pigments, which have been deemed to fail to exhibit sufficient transparency when formulated by a general dispersion method, in an amorphous phase in a binder resin.

The inventors also developed an extremely easy and simple method for dispersing acetoacetanilide type monoazo pigments in an amorphous phase in a binder resin.

The present invention has thus been reached based on these findings.

Accordingly, an object of the present invention is to provide a yellow toner which satisfies various characteristic requirements for use in color electrophotography, particularly high transparency and satisfactory spectral reflection characteristics.

Another object of the present invention is to provide a process for producing such a yellow toner with ease.

Other objects and effects of the present invention will be apparent from the following description.

The present invention provides an electrophotographic yellow toner comprising a binder resin having dispersed therein acetoacetanilide type monoazo pigments in an amorphous phase.

The present invention also provides a process for producing an electrophotographic yellow toner, the process comprising a step of subjecting colorants containing acetoacetanilide monoazo pigments and a binder resin to heat treatment at a temperature higher than the softening point of said binder resin by at least 40° C.

DETAILED DESCRIPTION OF THE INVENTION

Figure 1:
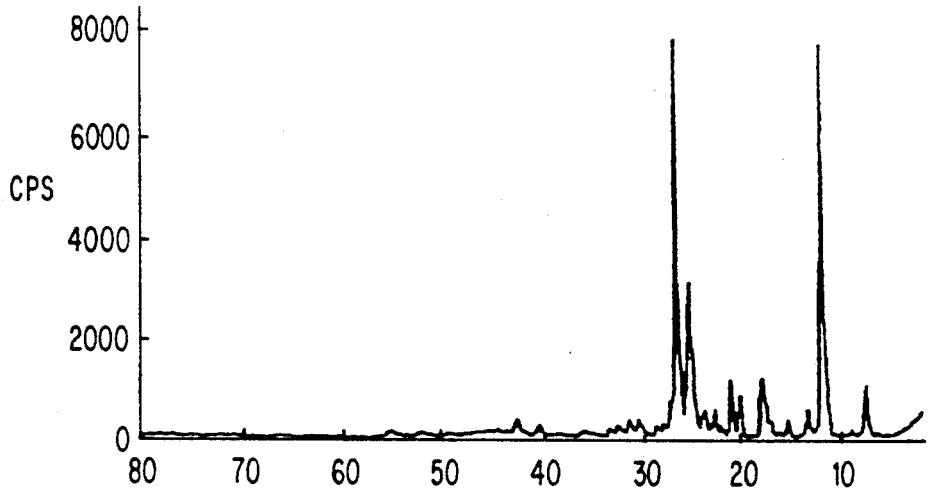
FIG. 1 is a powder X-ray diffraction pattern of C.I. Pigment Yellow 74.

The acetoacetanilide monoazo pigments which can be used in the present invention include compounds represented by formula (I):

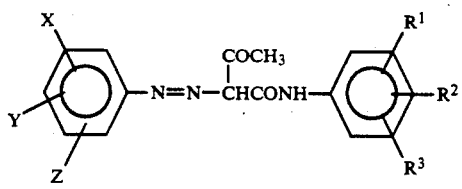

(I)

wherein X, Y, and Z each preferably independently represent a nitro group, a halogen atom, an alkyl group, an alkoxy group, or a hydrogen atom; and $R^1$, $R^2$, and $R^3$ each preferably independently represent an alkyl group, an alkoxy group, a halogen atom, or a hydrogen atom.

In formula (I), the alkyl group and alkoxy group each preferably contain from 1 to 5 carbon atoms.

Of the compounds represented by formula (I), preferred are those wherein at least one of X, Y, and Z is a nitro group.

Specific examples of the acetoacetanilide monoazo pigment are shown below.

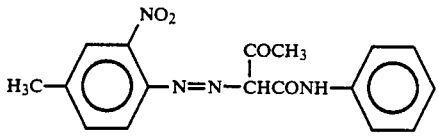

C.I. Pigment Yellow 1

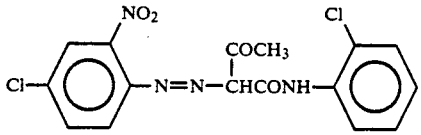

C.I. Pigment Yellow 3

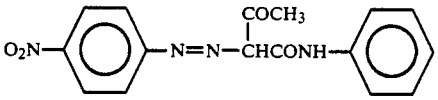

C.I. Pigment Yellow 4

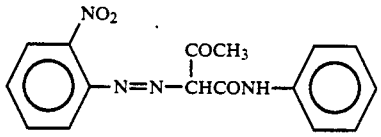

C.I. Pigment Yellow 5

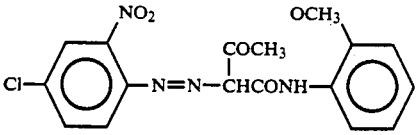

C.I. Pigment Yellow 73

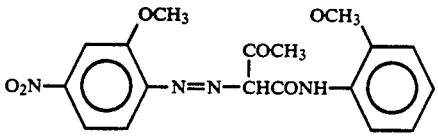

C.I. Pigment Yellow 74

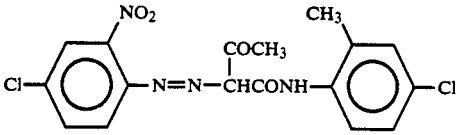

C.I. Pigment Yellow 98

-continued

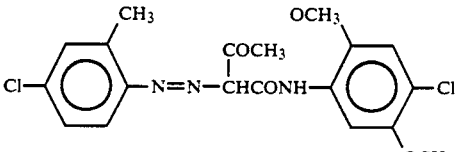

C.I. Pigment Yellow 49

A preferred content of the acetoacetanilide monoazo pigments in the yellow toner preferably ranges from 0.1 to 20 parts by weight, and more preferably form 1 to 10 parts by weight, per 100 parts by weight of a binder resin.

Binder resins which can be used in the present invention are selected from a wide range inclusive of known binder resins. Examples of useful binder resins include styrene resins, e.g., polystyrene, a styrene-acrylic ester copolymer, a styrene-methacrylic ester copolymer, and a styrene-butadiene copolymer; saturated polyester resins, unsaturated polyester resins, epoxy resins, phenol resins, coumarone resins, chlorinated paraffins, xylene resins, vinyl chloride resins, polyethylene and polypropylene. These resins may be used either individually or in combination of two or more thereof. Of these binder resins, preferred are styrene resins, saturated or unsaturated polyester resins, and epoxy resins.

The present inventors ascertained that dispersion of the acetoacetanilide monoazo pigment in an amorphous phase in the binder resin provides a toner having markedly improved transparency.

Various methods can be adopted for dispersing the acetoacetanilide monoazo pigments in an amorphous phase in a binder resin. For example, it is preferably carried out by melt-kneading a mixture containing a binder resin and an acetoacetanilide monoazo pigment at a temperature at which the pigment is dissolved in the binder resin or the pigment is fused; or preparing a master batch containing a resin, the monoazo pigments, and other additives at a prescribed temperature before melt-kneading. A method of subjecting a molten mixture of the binder resin and the monoazo pigments to post-heat treatment is also employable. It is also possible, while depending on the kind of the binder resin used, to disperse the pigments in the binder resin when they are polymerized.

The present inventors found that when a mixture comprising the binder resin having dispersed therein the acetoacetanilide monoazo pigment is subjected to heat treatment at a temperature higher than the softening point of the binder resin by at least 40° C, preferably at least 50° C, and more preferably at least 65° C, the resulting toner exhibits significantly improved transparency over that of a toner having no such a thermal history.

The above-described improvement in transparency is considered to be attributed to dissolution of the monoazo pigments in the resin by sufficient heating. The higher the heating temperature, the higher the degree of dissolution of the monoazo pigments in the resin, bringing about a further ensured improvement in transparency. While it is preferable to raise the heating temperature unless the pigments decompose, too high a temperature is inefficient and also may cause undesired effects. Accordingly, a practical heating temperature is generally 250° C at the highest, and preferably not more than 220° C.

The heat treatment of the mixture can be carried out by various methods. It is preferable to heat the mixture to a predetermined temperature during melt-kneading or to prepare a master batch containing resins, monoazo pigments and other additives at a predetermined temperature before melt-kneading. A method of heating the molten mixture after melt-kneading as a post-treatment may also be employable.

If desired, the toner of the present invention may contain known colorless charge control agents. For example, a metal complex or salt of salicylic acid or an alkylsalicylic acid can be added for obtaining a negative charged toner, and a quaternary ammonium salt or a salt-forming compound therefor can be added for obtaining a positive charged toner. These charge control agents are generally used in an amount of from 0.1 to 30% by weight based on the toner.

The toner may further contain various waxes as a parting agent for improving thermal characteristics.

The toner may furthermore have added from 0.01 to 3% by weight of a fluidity improving agent, such as colloidal silica.

A cleaning aid, such as a metal salt of stearic acid, can also be added to the toner.

The toner of the present invention is preferably used together with a carrier to prepare a two-component developer. The toner may also be used as a one-component developer of a touch-down system, etc.

Known carriers, such as iron powder or ferrite powder having a particle size of from about 50 to 200 μm, can be used in combination with the toner of the present invention. The carrier may be surface-treated with a silicone resin, an acrylic resin, a fluorine type resin, etc. or a mixture thereof. A preferred weight ratio of carrier to toner (carrier/toner) is, from 100/1 to 100/10.

The yellow toner of the present invention can be prepared through various processes inclusive of known ones as far as the acetoacetanilide monoazo pigments should be present in an amorphous phase. A general process for producing the toner of the present invention is described below for illustration.

(1) A binder resin and a colorant and, if desired, other additives such as a charge control agents are uniformly dispersed in, e.g., a Henschel mixer. (2) The resulting blend is melt-kneaded at a temperature for realizing an amorphous phase by means of, e.g., a kneader, an extruder, or a roll mill. (3) The molten mixture is granulated by means of a hammer mill, a cutter mill, etc. and then finely pulverized by means of a jet mill, a Impact type jet mill, etc. (4) The particles are classified by means of a DS (dispersion separator), a zigzag classifier, etc. (5) If desired, silica, etc. is dispersed in the classified particles by means of a Henschel mixer, etc.

The present invention is now illustrated in greater detail by way of Examples, but it should be understood that the present invention is not construed as being limited thereto. All the parts and percents are given by weight unless otherwise indicated.

EXAMPLE 1

| | |
|---|---|
| Polyester resin (softening point: 115° C.) synthesized from bisphenol A and terephthalic acid | 100 parts |
| Hansa Yellow 10G (C.I. Pigment Yellow 3) | 5 parts |
| Charge control agent (chromium complex of 3,5-di-t-butylsalicylic acid) | 1 part |

The above components were melt-kneaded at 180° C in a hot roll mill. After cooling, the blend was granulated in a hammer mill and then finely pulverized in an air jet system pulverizer. The resulting particles were classified to obtain a toner having a particle size of from 5 to 20 μm.

The X-ray diffractometry of the resulting toner revealed no crystal pattern of C.I. Pigment Yellow 3.

To the toner particles was added 0.3% of hydrophobic silica "R972" (Nippon Aerosil Co.) in a Henschel mixer to prepare a yellow toner.

Three parts of the toner were mixed with 97 parts of a carrier, ferrite powder of 100 μm in average size having been coated with a silicone resin, in a V-type blender to obtain a negative charged developer.

Copying was carried out by the use of the resulting developer and a commercially available dry copying machine using a selenium photoreceptor. As a result, copies having a distinct yellow color and excellent spectral reflection characteristics were obtained. When copies were taken on a transparent sheet, a highly transparent image was obtained, which gave a projected image of distinct yellow on projection with OHP.

Further, a running test was conducted by using the developer and the same copying machine under a normal temperature and normal humidity condition (25° C, 60% RH). As a result, more than 20,000 copies free from fog and having a distinct yellow color were obtained, proving that the developer had excellent durability.

When the same running test was conducted under a high temperature and high humidity condition (35° C, 85% RH), more than 20,000 copies free from fog and having a distinct yellow color were obtained, proving that the developer had stable performance properties against changes of environmental conditions.

EXAMPLE 2

| | |
|---|---|
| Polyester resin (softening point: 120° C.)) synthesized from bisphenol A and terephthalic acid | 100 parts |
| Hansa Brilliant Yellow 5GX (C.I. Pigment Yellow 74) | 5 parts |
| Charge control agent (salt-forming compound of benzyltributylammonium chloride and naphtholsulfonic acid) | 3 parts |

The above components were melt-kneaded at 220° C in a hot roll mill. After cooling, the blend was granulated by means of a hammer mill and then finely pulverized in an air jet system pulverizer. The resulting particles were classified to obtain a toner having a particle size of from 5 to 20 μm.

Figure 3:
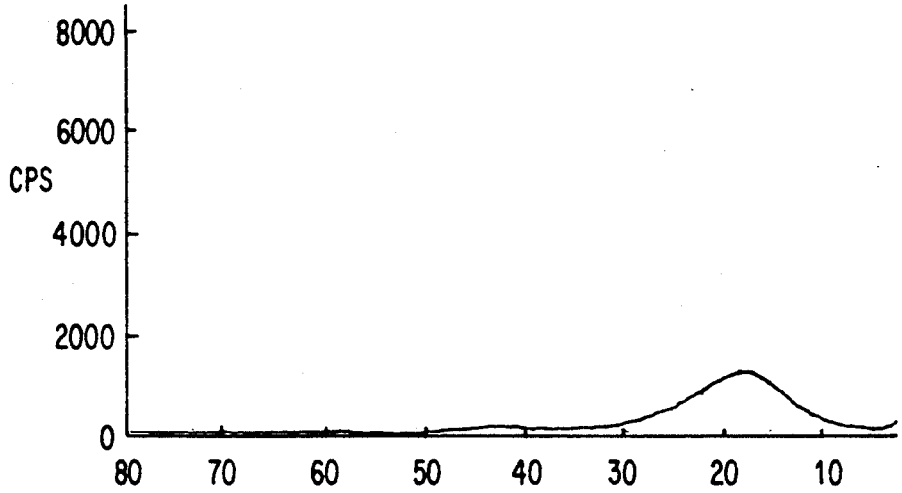
FIG. 3 is a powder X-ray diffraction pattern of a toner having dispersed therein C.I. Pigment Yellow 74 in its amorphous phase (Example 2).

The result of an X-ray diffractometry of the resulting toner is shown in FIG. 3. It revealed no crystal pattern of C.I. Pigment Yellow 74. FIG. 1 shows the result of an X-ray diffractometry of C.I. Pigment Yellow 74 for reference.

To the toner particles was added 0.3% of hydrophobic silica "R972" in a Henschel mixer to prepare a yellow toner.

Three parts of the toner were mixed with 97 parts of a carrier, ferrite powder of 100 μm in average size having been coated with a silicone resin, in a V-type blender mixer to obtain a positive charged developer.

Copying was carried out by the use of the resulting developer and a commercially available dry copying machine using an organic photoreceptor. As a result, copies having a distinct yellow color and excellent spectral reflection characteristics were obtained. When copies were taken on a transparent sheet, highly transparent images were obtained, which gave projected images of distinct yellow on projection with OHP.

Further, a running test was conducted by using the developer and the same copying machine under a normal temperature and normal humidity condition (25° C, 60% RH). As a result, more than 20,000 copies free from fog and having a distinct yellow color were obtained, proving that the developer had excellent durability.

When the same running test was conducted under a high temperature and high humidity condition (35° C., 85% RH), more than 20,000 copies free from fog and having a distinct yellow color were obtained, proving that the developer had stable performance properties against changes of environmental conditions.

COMPARATIVE EXAMPLE 1

| | |
|---|---|
| Polyester resin (softening point: 120° C.) synthesized from bisphenol A and terephthalic acid | 100 parts |
| Hansa Brilliant Yellow 5GX (C.I. Pigment Yellow 74) | 5 parts |
| Charge control agent (salt compound of benzyltributylammonium chloride and naphtholsulfonic acid) | 3 parts |

The above components were melt-kneaded at 140° C. in a hot roll mill. After cooling, the blend was granulated by means of a hammer mill and then finely pulverized in an air jet system pulverizer. The resulting particles were classified to obtain a toner having a particle size of from 5 to 20 μm.

Figure 2:
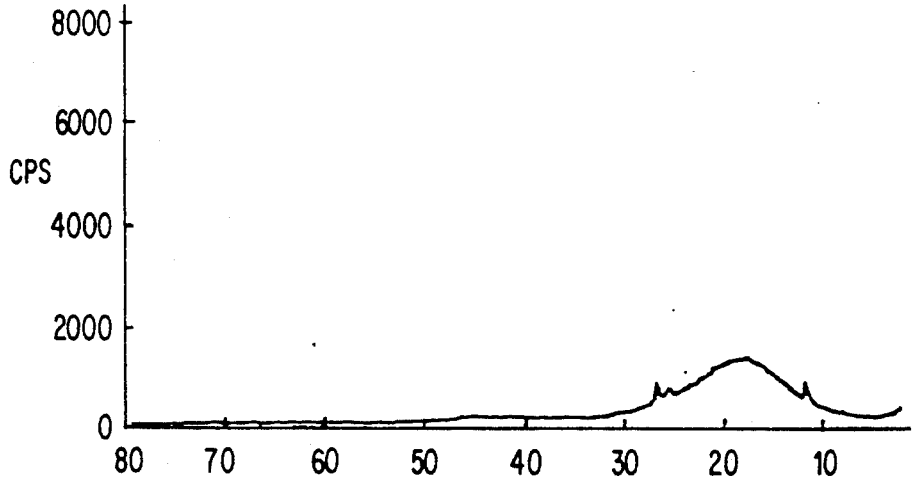
FIG. 2 is a powder X-ray diffraction pattern of a toner having dispersed therein C.I. Pigment Yellow 74 by a conventional kneading method (Comparative Example 1).

The result of an X-ray diffractometry of the resulting toner is shown in FIG. 2. It partly revealed the crystal pattern of C.I. Pigment Yellow 74.

To the toner particles was added 0.3% of hydrophobic silica "R972" in a Henschel mixer to prepare a yellow toner.

Three parts of the toner were mixed with 97 parts of a carrier, ferrite powder of 100 μm in average size having been coated with a silicone resin, in a V-type blender to obtain a positive charged developer.

Copying was carried out by the use of the resulting developer and a commercially available dry copying machine using an organic photoreceptor. As a result, copies having a distinct yellow color and excellent spectral reflection characteristics were obtained. However, when copies were taken on a transparent sheet and projected with OHP, the projected image did not show a distinct yellow color.

As described above, the yellow toner according to the present invention has satisfactory spectral reflection characteristics and excellent transparency and also exhibits excellent performance stability against environmental changes and excellent durability. That is, the yellow toner of the present invention satisfies all the characteristic requirements as a color toner sufficiently and in a good balance. The present invention also provides a process for obtaining such a yellow toner with ease.

While the invention has been described in detail and with reference to specific examples thereof, it will be apparent to one skilled in the art that various changes and modifications can be made therein without departing from the spirit and scope thereof.

What is claimed is:

1. An electrophotographic yellow toner comprising a binder resin having dispersed therein an acetoacetanilide monoazo pigment in an amorphous phase.

2. An electrophotographic yellow toner as claimed in claim 1, wherein said acetoacetanilide monoazo pigment is a compound represented by formula (I):

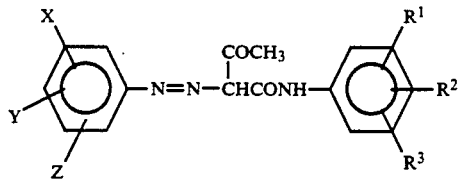

(I)

wherein X, Y, and Z each independently represent a nitro group, a halogen atom, an alkyl group, an alkoxy group, or a hydrogen atom; and $R^1$, $R^2$, and $R^3$ each independently represent an alkyl group, an alkoxy group, a halogen atom, or a hydrogen atom.

3. An electrophotographic yellow toner as claimed in claim 2, wherein at least one of X, Y, and Z is a nitro group.

4. An electrophotographic yellow toner as claimed in claim 1, wherein said acetoacetanilide monoazo pigment is selected from the group consisting of C.I. Pigment Yellow 1, C.I. Pigment Yellow 3, C.I. Pigment Yellow 4, C.I. Pigment Yellow 5, C.I. Pigment Yellow 73, C.I. Pigment Yellow 74, C.I. Pigment Yellow 98, and C.I. Pigment Yellow 49.

5. An electrophotographic yellow toner as claimed in claim 1, wherein said acetoacetanilide monoazo pigment is present in an amount of from 0.1 to 20 parts by weight per 100 parts by weight of said binder resins.

6. An electrophotographic yellow toner as claimed in claim 1, wherein said binder resin is selected from the group consisting of a styrene resin, a saturated or unsaturated polyester resin, an epoxy resin, a phenol resin, polyethylene, and polypropylene.

7. An electrophotographic yellow toner comprising a colorant and a binder resin, said colorant containing a acetoacetanilide monoazo pigment, and said colorant and binder resin having a thermal history of being heated at a temperature higher than the softening point of the binder resin by at least 40° C.

8. A process for producing an electrophotographic yellow toner containing a colorant and a binder resin, said process comprising the step of subjecting colorant containing a acetoacetanilide monoazo pigment and a binder resin to thermal treatment at a temperature higher than the softening point of the binder resin by at least 40° C.

9. A process as claimed in claim 8, wherein said thermal treatment is at a temperature higher than the softening point of the binder resin by at least 50° C.

* * * * *